US009556877B2

(12) United States Patent
Meuter et al.

(10) Patent No.: US 9,556,877 B2
(45) Date of Patent: Jan. 31, 2017

(54) PUMP AND DRIVE BEARING FOR A PUMP

(71) Applicant: Sulzer Pumpen AG, Winterthur (CH)

(72) Inventors: Paul Meuter, Seuzach (CH); Thomas Welschinger, Radolfzell (DE)

(73) Assignee: Sulzer Management AG, Winterthur (CH)

( * ) Notice: Subject to any disclaimer, the term of this patent is extended or adjusted under 35 U.S.C. 154(b) by 786 days.

(21) Appl. No.: 13/900,483

(22) Filed: May 22, 2013

(65) Prior Publication Data

US 2013/0315730 A1 Nov. 28, 2013

(30) Foreign Application Priority Data

May 22, 2012 (EP) ..... 12168930

(51) Int. Cl.
*F04D 29/046* (2006.01)
*F04D 29/047* (2006.01)
*F04D 29/06* (2006.01)

(52) U.S. Cl.
CPC ..... *F04D 29/046* (2013.01); *F04D 29/0473* (2013.01); *F04D 29/061* (2013.01)

(58) Field of Classification Search
CPC ..... F04D 29/061; F04D 29/06; F04D 29/046; F04D 29/0473
See application file for complete search history.

(56) References Cited

U.S. PATENT DOCUMENTS 3,128,713 A * 4/1964 Nechine ..... F04D 29/061 415/111
4,958,988 A 9/1990 Regev
5,397,220 A 3/1995 Akihisa

FOREIGN PATENT DOCUMENTS

DE 2312546 3/1973

OTHER PUBLICATIONS

European Search Report mailed Oct. 23, 2012 in European Application No. 12168930.1, 7 pages.

* cited by examiner

*Primary Examiner* — Richard Edgar
(74) *Attorney, Agent, or Firm* — Kilpatrick Townsend & Stockton LLP

(57) ABSTRACT

A pump for conveying a pump fluid, wherein the pump fluid provided at an inlet pressure at a low pressure side of the pump can be conveyed in the operating state to a high pressure side of the pump rotor by means of a pump rotor rotatably supported about an axis of rotation in a pump stator and wherein a rotor shaft is arranged with the pump rotor at it drive bearing formed as a shaft bearing, characterized in that a lubricating film which is formed from a lubricating fluid formed from the pump fluid can be formed on a drive side of the rotor shaft between the rotor shaft and a drive bearing in a lubricating ring gap, with a lubricant line being provided such that the lubricating fluid can be supplied to the lubricating ring gap between the rotor shaft and the drive bearing.

13 Claims, 3 Drawing Sheets

PRIOR ART

PUMP AND DRIVE BEARING FOR A PUMP

Figure 1:
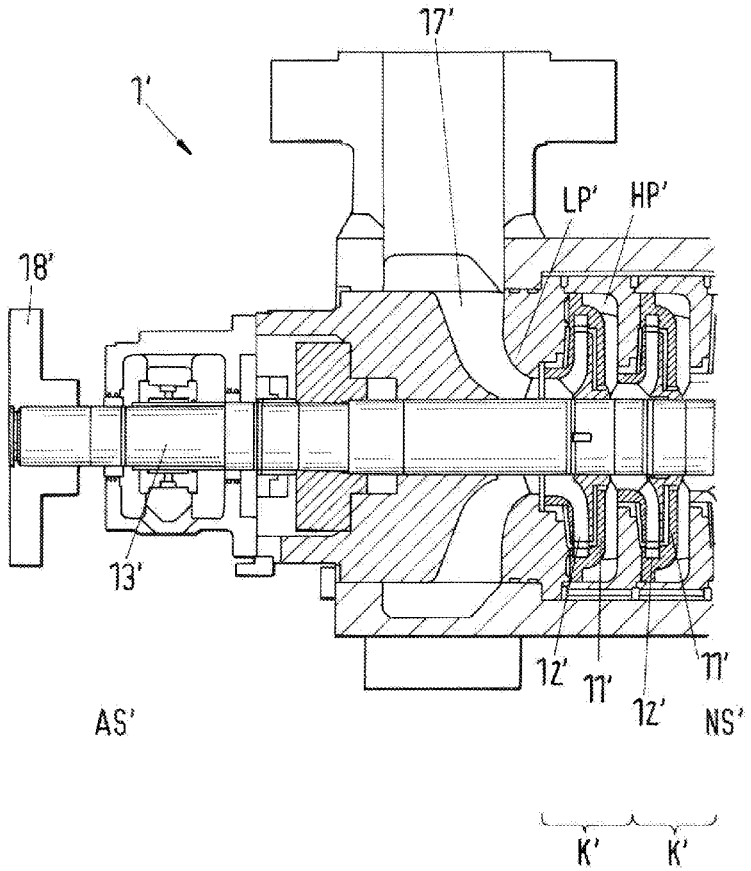

This application claims priority to European Application No. 12168930.1 filed on May 22, 2012, the disclosure of which is incorporated by reference herein.

The invention relates to a pump for conveying a pump fluid as well as to a drive bearing for a pump in accordance with the preamble of all claims.

Pumps, in particular centrifugal pumps, are well-known flow machines from the prior art and are used in the most varied applications for conveying pump fluids, for example liquids or mixtures. The main components of a pump, that is a housing, a rotor shaft, bearings for the rotor shaft as well as a pump rotor, and the basic design of pumps are known per se.

In the operating state, the rotor shaft is driven by a drive which can be coupled to the rotor shaft by means of a coupling and the pump fluid flows from an intake pipe to a pump rotor, with the pump rotor arranged on the rotor shaft transmitting the energy required for the conveying onto the pump fluid. The pump rotor itself is composed, for example, of a hub body which forms a unit with a support plate, of vanes which transmit energy onto the pump fluid and, depending on the application, of a cover plate. The side of the rotor shaft to which the drive is coupled is designated as the drive side and the oppositely disposed side as the non-drive side for spatial orientation. The pressure distribution is described with reference to the position relative to the pump rotor; the intake side of the pump rotor corresponds to the low pressure side, whereas the oppositely disposed side, that is the region after the pump rotor, is known as the high pressure side. A distinction is generally made between single-stage pumps and multistage pumps, with the multistage pumps being designed so that a plurality of pump rotors are arranged in series behind one another and the pressure of the pump fluid increases after running through each pump stage. With multistage pumps, the rotor shaft is supported on special bearing carriers or on the non-drive side in a special outer bearing, among other things to damp vibrations, since the vibration sensitivity of the pump increases as the length of the rotor shaft increases.

It is known from the prior art that vibrations of different types are one of the most frequent causes for operating problems with pumps. Dynamic forces of mechanical and hydraulic origin act in every pump; in particular in pumps with fast-rotating rotor shafts or of changing speeds, mechanical vibrations thereby arise which cause substantial problems. The vibrations are in part pump-induced, e.g. by the excitation of eigenfrequencies of the pump or its parts or by mechanical imbalances of the rotating parts due to improper balancing. These eigenfrequencies are in particular excited by unavoidable imbalances of the rotor shaft on changes of the rotational speed of the rotor shaft. On the other hand, such pumps are exposed to vibrations due to their environmental and assembly conditions which should be kept away from the rotor system. Essentially, the damping of the rotor shaft and the decoupling of the housing from the rotor shaft for suppression of the vibration transfer are significant in the observation of vibrations. At high speeds, the known arrangements for supporting the rotor shaft are moreover no longer sufficient since the rotor shaft usually starts to vibrate a lot.

A substantial effect which is utilized on the support of rotor shafts and on the damping of vibrations of rotor shafts on the non-drive side is the Lomakin effect. Due to the Lomakin effect, the rotor shaft is centered in ring gaps flowed through axially when it is deflected. The centering effect is caused in that the spacings or gaps between the rotor shaft and the drive bearings increase or decrease due to the deflection of the rotor shaft, with the flow speed of the lubricating fluid being smaller in the region of the smaller spacing or of a smaller gap than in the region of larger spacings. A pressure difference arises due to the larger inlet loss which in turn corresponds to a restoring force directed against the deflection which has a centering effect on the rotor shaft.

A further solution for damping vibrations is known from EP 0 867 627 B1. A damping system for magnetically supported rotor shafts is described there which proposes providing an intermediate member between the rotor and the housing which is supported in the housing via balls, with the balls resting in caps. It is disadvantageous in this solution that enormous restoring forces arise even with the smallest deflection of the balls independently of the material used and of the cap radius. One reason for this is that the selection of the ball material and cap material is limited by the other forces acting in the pump, for example by the weight of the rotor or the bearing forces acting along the rotor axle in permanent magnetic bearings. It can ultimately be stated that the desired function is only satisfied in an insufficient manner and that the design of the damping system is complex and high-maintenance.

It is therefore the object of the invention to propose a pump in which the harmful vibrations of the rotor shaft on the drive side are largely avoided and the vibrations of the rotor shaft are reduced or damped to a predefinable degree so that a higher efficiency of the pump and/or an improved running of the rotor shaft is achieved in the operating state.

The subject matters of the invention satisfying this object are characterized by the features of all claims.

The dependent claims relate to particularly advantageous embodiments of the invention.

The invention thus relates to a pump for conveying a pump fluid, with the pump fluid provided at an inlet pressure at a low pressure side of the pump being able to be conveyed in the operating state to a high pressure side of the pump rotor by means of a pump rotor rotatably supported about an axis of rotation in a pump stator and a rotor shaft being arranged with the pump rotor at a drive bearing formed as a shaft bearing. In accordance with the invention, a lubricating film of a lubricating fluid formed from the pump fluid can be formed in a lubricating ring gap on a drive side of the rotor shaft between the rotor shaft and the drive bearing, with a lubrication line being provided such that the lubricating fluid can be supplied to the lubricating ring gap between the rotor shaft and the drive bearing.

It is thus important for the invention that the lubricating ring gap is provided as a hydrodynamic stabilization element on the drive side, with a hydrodynamic lubricating film being formed in the lubricating ring gap in the operating state of the pump. The lubricating film which is formed from the lubricating fluid, which is turn formed from the pump fluid to be conveyed by the pump and is preferably taken as pump fluid from the high pressure side of the pump rotor, is supplied to the lubricating gap on the drive side by means of the lubricant line. A bearing on the drive side, for example the drive bearing, is in particular particularly suitable for such an arrangement since it can take up both vibrations applied to the pump from the outside and vibrations excited within the pump.

In simplified terms, the pumping fluid or lubricating fluid is transported from the high pressure side to the low pressure side, in particular to the drive bearing, to form a hydrodynamic lubricating film in a lubricating ring gap in the operating state of the pump. The rotor shaft dynamics are thus decisively improved by the present invention because the damping and stiffness of the vibration-capable rotor system is decisively increased by the stabilizing film.

Harmful vibrations of the rotor shaft are thereby largely avoided or are at least reduced or damped to a predefinable tolerable degree so that the pump can also be operated at a speed of revolution or in a specific revolution field, in particular at high speeds, where this was previously not possible without the use of a lubricating ring gap in accordance with the invention with a lubricating film. Furthermore even a higher efficiency of the pump and a smoother, improved running of the rotor in the operating state can possibly be achieved, which ultimately has the result that not only energy for the operation of the pump can be saved, but also the service intervals can be extended, whereby the costs associated therewith can be dramatically lowered and simultaneously the service life of the pump is also substantially increased.

In this respect, the degree, thus the amount of the damping, can be adapted in a simple manner in dependence on the technical demands or specifications in a pump in accordance with the invention. This can be done, for example, by a suitable selection of the geometry, in particular of the geometrical shape or width of the lubricating ring gap, or in that, for example, the pressure of the lubricating fluid introduced into the lubricating ring gap by means of a valve known per se can be controlled and/or regulated. The supply of lubricant from different pump stages, that is at different pressures, into the lubricating ring gap is also a measure for controlling and regulating the damping.

The drive bearing is specifically designed in two parts, including a main drive bearing and a pre-bearing. Various advantageous embodiments or embodiment variants of the invention can be realized due to the at least two-part design. The lubricating film which forms in the lubricating ring gap in the operating state can thus be formed between the pre-bearing and the rotor shaft or between the main bearing and the rotor shaft, with the course of the pump fluid and lubricating fluid changing due to the different embodiments or embodiment variants. These embodiments or embodiment variants will be described in more detail in the following.

As a particularly preferred measure, a lubricant opening is provided on a high pressure side of a pump stage, preferably the first pump stage, and the lubricant opening is in flow communication with the lubricant line and/or a supply bore for supplying the lubricating fluid is provided in the drive bearing. The removal of the pump fluid, which is used as lubricating fluid, is regulated by means of the lubricant opening which can be designed as a simple bore, as a valve or as a component for blocking or regulating the through-flow of the pump fluid. It is possible by this advantageous measure to use the pump fluid of the high pressure side as the lubricating fluid; the pump fluid is therefore taken from a region of the pump in which the pump fluid has a higher pressure than the inlet pressure on the low pressure side. It is moreover possible via the lubricant opening which can be connected to the lubricant line to allow the pump fluid to flow from the high pressure side into regions with a lower pressure, for example to the low pressure side. For this purpose, special passages or lines can be provided, for example, in or at the pump housing as lubricant lines which connect the lubricant opening to the supply bore.

As a very advantageous measure, the pump fluid used as the lubricating fluid flows via the lubricant line into the supply bore of the drive bearing and can be supplied from there, for example, as lubricating fluid to the lubricating ring gap. Since the drive bearing is disposed on the low pressure side, which corresponds to the drive side, the lubricating fluid automatically flows, that is without any external forces, from the lubricant opening in the direction of the supply bore due to the pressure difference. Analog to the lubricant opening, the supply bore can be designed as a simple bore, as a valve or as a component for blocking and is used for controlling and regulating the supply of the lubricating fluid.

In a particularly preferred embodiment, the lubricating ring gap and the low pressure side are in flow communication and the lubricant flows along the rotor shaft in the direction of the low pressure side. Since the lubricating ring gap and the low pressure side are in flow communication and the lubricant flows in with the pressure of the high pressure side via the supply bore, an axial flow from the lubricating ring gap is generated in the direction of the low pressure side due to the described design and the rotor shaft is centered when it is deflected from its rest position into the radial direction. The centering effect which corresponds to the described Lomakin effect is, as already described, caused in that the spacings or gaps between the rotor shaft and the driving bearing increase or decrease due to the deflection of the rotor shaft, whereby a pressure difference arises which in turn effects a restoring force directed against the deflection and which acts in a centering manner on the rotor shaft.

It thus becomes possible for the first time by the present invention to utilize a centering effect on the drive side and to decisively improve the damping and stiffness of a vibrating rotor shaft, in particular at high speeds.

An embodiment variant of the invention provides that a bearing chamber is in particular provided on the drive side at the drive bearing between the main drive bearing and the pre-bearing and the bearing chamber and the lubricating ring gap are in flow communication. In addition, a compensation line can be provided between the bearing chamber and the low pressure side such that the lubricating field can flow from the bearing chamber into the low pressure side in the operating state. A pressure difference analog to the previous embodiment by which the vibrations of the rotor shaft are advantageously damped and the rotor shaft is centered is also produced in this variant in that the lubricating ring gap and the bearing chamber are in flow communication, that is the lubricating fluid flows, for example, from the lubricating ring gap into the bearing chamber, and/or by means of the compensation line. In addition, this variant makes it possible to combine a drive bearing with a lubricating ring gap so that the invention can be realized in a less complex and a less expensive manner based on known drive bearings at which a bearing chamber is present since use can be made of existing construction solutions and at least specific types of pumps can possibly also be retrofitted.

As a further variant which is advantageous in practice, the lubricating fluid can be supplied to the lubricating ring gap via the bearing chamber so that the lubricating fluid can flow, for example, from the high pressure side via the lubricant line into the bearing chamber and then into the lubricating ring gap. The advantage of this embodiment in accordance with the invention is the very simple construction design, whereby existing pumps can be retrofitted very simply with a damping system and new pumps can be equipped very inexpensively with the additional damping.

In a further advantageous embodiment, in dependence on the construction type and on the design of the pump, a pre-bearing bore is provided in the pre-bearing for the supply of the lubricating fluid into a pre-bearing gap between the pre-bearing and the rotor shaft and/or a pre-bearing chamber is provided before the pre-bearing on the drive side and/or a pre-bearing line is provided between the pre-bearing chamber and the low pressure side such that the lubricating fluid can flow from the pre-bearing chamber into the low pressure side in the operating state. The mode of operation of this variant substantially corresponds to the already described statements; only the design of the lubricating ring gap between the pre-bearing and the rotor shaft, the axial flow of the lubricating fluid from the pre-bearing in the direction of the pre-bearing chamber and the pre-bearing line between the pre-bearing chamber and the low pressure side are different.

As will be explained further below by way of example for a particularly preferred embodiment with reference to FIG. 2, the pump can be designed as a multistage pump and includes at least one further pump rotor rotatably supported about an axis of rotation. A further lubricant opening is provided at the high pressure side of a further pump stage and the further lubricant opening is in flow communication with the lubricant line.

It is thus possible, for example, alternatively to supply the lubricating fluid to the lubricating ring gap from different pressure stages of the pump or pump stages, whereby the pressure in the lubricating ring gap and thus the degree of damping or the stiffness of the vibration-capable rotor is likewise set in a very simple manner and can be set very flexibly to different demands and changing operating conditions.

A further particular advantage is that it is possible for the first time by the invention to construct pumps with a much higher number of pump stages than was previously possible. The possible number of pump stages was previously restricted simply by the vibrations of the rotor shaft which increase hugely as the number of pump stages increases. The rotor shaft can be reliably stabilized over practically any desired length by the invention.

In this respect, the pump can also include an external source for supplying the lubricating fluid, with the external source not corresponding to a pump stage. It is understood in this respect that the pump fluid can also be provided by other external sources in specific cases, for example by a pressure reservoir or by a pump which provides the medium for the formation of the stabilization layer for introduction into the lubricating ring gap at a predefinable pressure, especially at a pressure which can be controlled and/or regulated. The lubricating fluid also does not necessarily have to be the pump fluid to be pumped, but can rather also be another medium, e.g. an oil, water, or another liquid or gaseous medium or fluid.

The invention further relates to a drive bearing for a pump in accordance with the invention, with a supply bore for supplying the lubricating fluid being provided in the drive bearing.

It is thus possible by using specific embodiment variants of the bearing drive to retrofit existing pumps from the prior art so that the whole pump does not have to be replaced to make use of the advantages of the invention. This is possible, for example, in that a drive bearing in accordance with the invention is simply adapted to the geometry of a known older pump and is installed in it within the framework of a regular service. This means that older drive bearings, which have the initially described problems with the harmful vibrations, are simply replaced with drive bearings in which the present invention is realized.

As a special measure, a supply bore can also be provided at the drive bearing in accordance with the invention which is designed as a valve or as a component for blocking and serves for the control or regulation of the throughflow of the lubricating liquid. In this respect, the supply bore is preferably formed and arranged so that a predefinable quantity of lubricating fluid can be supplied for the forming of the hydrodynamic lubricant layer to the lubricating ring gap by means of the lubricant line which is formed, for example, as a line provided at or in the housing.

Figure 2:
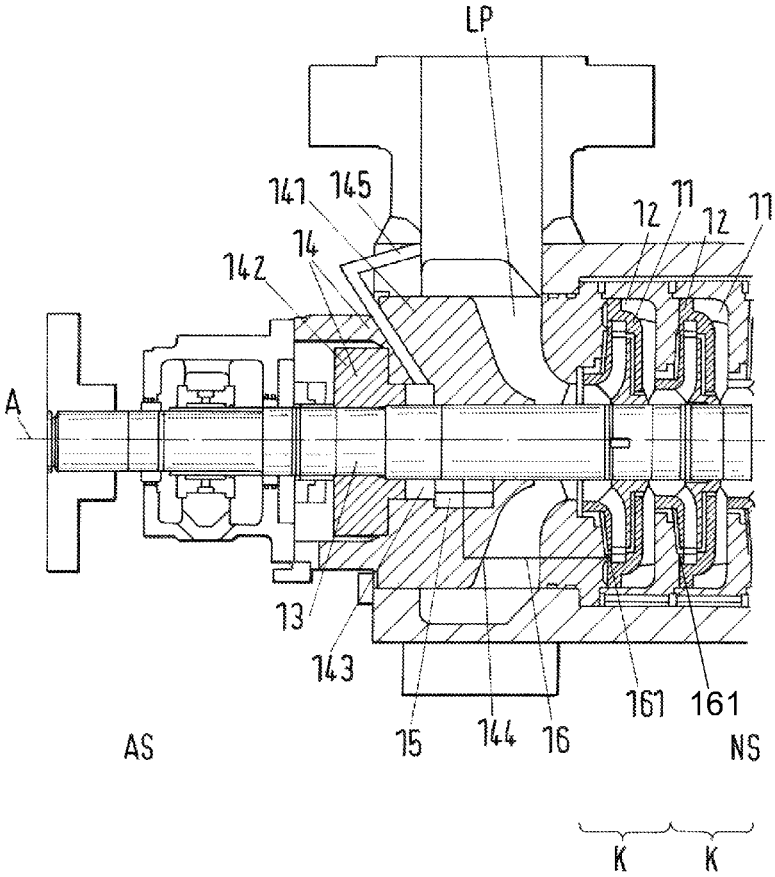

The invention will be explained in more detail in the following with reference to the drawing. There are shown in a schematic representation:

FIG. 1 the prior art for the example of a multistage pump;

FIG. 2 an embodiment of a pump in accordance with the invention; and

Figure 3:
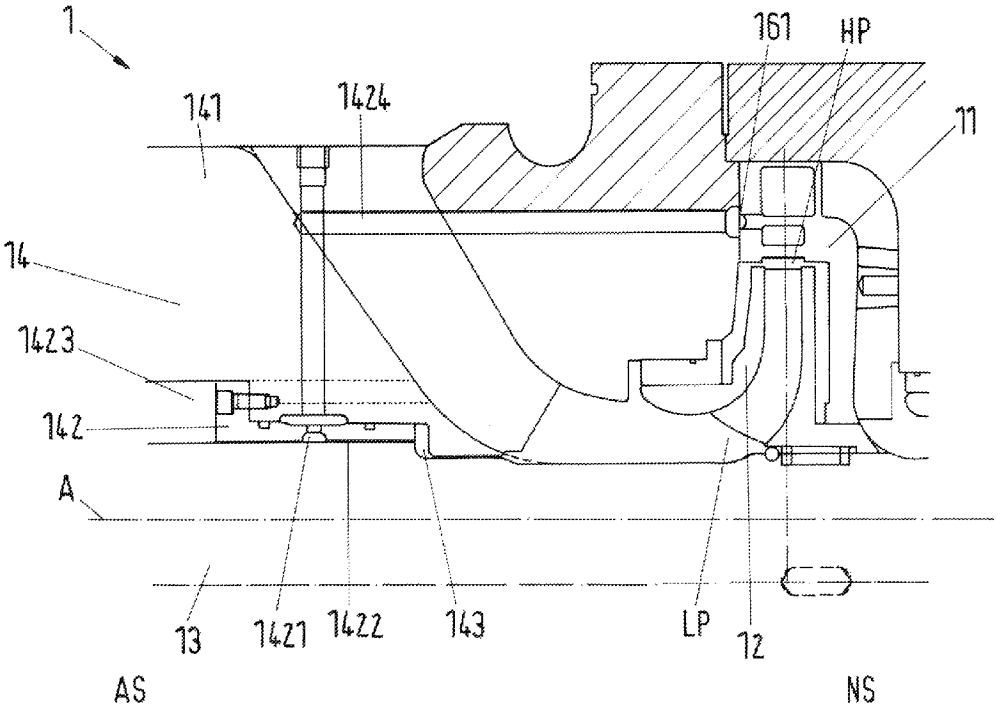

FIG. 3 a further embodiment of a pump in accordance with the invention.

It applies to the following description of the Figures that all the reference numerals which refer in the examples to the features of the prior art are provided with a dash and all the reference numerals which refer to features in accordance with the invention are not marked by a dash.

FIG. 1 shows the prior art in a schematic representation with reference to a multistage pump. In the operating state, the rotor shaft 13' is driven by a drive (not sown) which is coupled to the rotor shaft 13' by means of a coupling 18' and the pump fluid flows from the intake pipe 17' to the pump rotor 12', with the pump rotor 12' arranged on the rotor shaft 13' transmitting the energy required for the conveying to the pump fluid. The pump rotor 12' itself is composed of a hub body which forms a unit with a support plate (not shown) of vanes (not shown) which transmit energy onto the pump fluid and of a cover plate (not shown). The side of the rotor shaft 13' to which the drive is coupled is designated as the drive side AS' and the oppositely disposed side as the non-drive side NS' for spatial orientation. The pressure distribution before and after the pump rotor 12' can be described as follows: the intake side of the pump rotor 12' on which the pressure is lower, that is it corresponds to the inlet pressure, is designated as the low pressure side LP', whereas the oppositely disposed side on which the pressure of the pump fluid is higher than on the low pressure side LP' is designated as the high pressure side HP'. A distinction is generally made between single-stage pumps and multistage pumps 1' which are generally designed so that the rotor shaft 13' is supported in a bearing carrier and the pump rotor 12' is arranged in an overhung manner.

Since the pump 1' shown in FIG. 2 is a multistage pump 1', the pump 1' includes a plurality of pump stages K', with the pressure increasing from stage to stage. Each pump stage K' includes a pump rotor 12' and a pump stator 11' connected to it in accordance with the above-described design.

The pump rotor 12' and the pump stator 11' are in this respect aligned with respect to a common rotor shaft 13' such that the pump rotor 12' is set into rotation by the rotor shaft 13' in the operating state, whereas the pump stator 4' is decoupled from the rotational movement of the rotor shaft 13' and therefore does not rotate with respect to the pump rotor 12'. The majority of the pump stages K' are in this respect arranged in series behind one another in the substantially tubular pump housing (not shown).

To achieve a sufficiently high pressure of the pump fluid a plurality of pump stages are provided in series in practice, as already explained, each composed of a pump rotor 12' and a pump stator 11', which necessarily results in a considerable construction length of the rotor shaft 13'. The decisive disadvantage of such long rotor shafts 13' is that they can only be controlled with great difficulty with respect to vibration. The longitudinal rotor shafts 13' namely form a vibration-capable system in the interior of the tubular pump housing (not shown), said system in particular being able to form different transverse vibration modes which can be so intensive that the pump 1' can no longer be operated at a preset number of revolutions or in a specific revolution field. Furthermore, the efficiency of the pumps 1' can also be reduced and in the worst case even damage to the pump 1' is to be feared if the rotor shaft 13', for example, starts to vibrate so strongly and in such an uncontrolled manner that parts of the rotor shaft 13' such as the pump rotor 12' come into contact with the pump housing, for example, due to the vibration movement. In this respect, the kind and the intensity of the vibrations of the rotor 13' do not only depend on the specific geometry, but rather also on the operating condition of the pump 1', on the pump fluid to be pumped, on the speed of the pump 1' and on further known, and in some cases not exactly known parameters so that it is hardly possible to cope with the problems with the harmful vibrations of the rotor shaft 13' solely by an adaptation of the geometrical relationships of known pumps 1' or by using new materials.

A particularly preferred embodiment of a pump in accordance with the invention will be discussed in the following with reference to FIG. 2, with the pump in accordance with the invention, which is designated as a whole by the reference numeral 1 in the following, serving for conveying a pump fluid. In the operating state, the pump fluid provided at an inlet pressure to a low pressure side LP of the pump 1 can be conveyed to a high pressure side HP of the pump rotor 12 by means of a pump rotor rotatably supported about an axis of rotation A in a pump stator 11 and a rotor shaft 13 is arranged with the pump rotor 12 at a drive bearing 14 formed as a shaft bearing. In accordance with the invention, a lubricating film of a lubricating fluid formed from the pump fluid can be formed in a lubricating ring gap 15 on a drive side AS of the rotor shaft 13 between the rotor shaft 13 and the drive bearing 14, with a lubricant line 16 being provided such that the lubricating fluid can be supplied to the lubricating ring gap 15 between the rotor shaft 13 and the drive bearing 14.

In accordance with the invention, a hydrodynamic lubricating film is formed in the lubricating ring gap 15 provided on the drive side AS in the operating state, said hydrodynamic film being formed from the lubricating fluid which is in turn formed from the pump fluid to be conveyed by the pump and is preferably removed from the high pressure side HP of the pump rotor 12 as compressed pump fluid with a higher pressure. The supply of the lubricating fluid into the lubricating ring gap 15 takes place by means of the lubricant line 16. At the same time, the damping of the rotor shaft 13 can be set by a suitable choice of the geometry of the lubricating ring gap 15, with the shape and width of the lubricating ring gap 15 being freely selectable in principle.

The invention thus makes it possible very largely to avoid harmful vibrations of the rotor shaft 13 on the drive side AS in a particularly advantageous manner or they are at least reduced or damped to a predefinable tolerable degree so that the ump 1 can also be operated at high revolution speeds or also at unfavorable speeds in a part load region. Even a higher efficiency of the pump 1 and a smoother, improved running of the rotor shaft 13 in the operating state can furthermore be achieved. Which ultimately naturally has the result that not only energy for the operation of the pump 1 can be saved, but also the service intervals can be extended, whereby the costs associated therewith can be dramatically cut and the service life of the pump 1 is simultaneously also substantially increased.

In practice, the drive bearing 14 is often designed in two parts, including a main drive bearing 141 and a pre-bearing 142. Various advantageous embodiments or embodiment variants of the invention exist due to the at least two-part design. The lubricating film which is formed in the lubricating ring gap 15 in the operating state can thus form in the region of the pre-bearing 142 between the main bearing 141 and the rotor shaft 13, or also in both regions.

A lubricant opening 161 can be provided on the high pressure side HP of the pump and the lubricant opening 161 is in flow communication with the lubricant line 16. The pump fluid flows from the high pressure side HP in the operating state of the pump 1 into the lubricant line 161 through the lubricant opening 161 which is e.g. designed as a simple bore, as a valve or as a component for blocking and serves for controlling or regulating the throughflow of the pump fluid. A supply bore 144 for supplying the lubricant fluid is moreover provided in the drive bearing 14.

The lubricating fluid is supplied to the lubricating ring gap 15 via the drive bearing 14 by means of the supply bore 144 which is likewise designed as a simple bore, as a valve or as a component for blocking and serves for controlling or regulating the throughflow of the lubricating fluid. In addition, the damping properties of the lubricating film formed in the lubricating ring gap 15 can be influenced by means of the position of the supply bore 144 at the drive bearing 14.

Since the lubricating ring gap 15 and the low pressure side LP are in flow communication and since the lubricant flows along the rotor shaft in the direction of the low pressure side, an axial flow arises, whereby, on a deflection of the rotor shaft 13 from the centered position in the radial direction, a pressure difference arises and the restoring forces act on the rotor shaft 13 in the direction of the position of rest.

The embodiment variant shown in FIG. 2 provides that a bearing chamber 143 is provided at the drive bearing 14 the drive side, in particular between the main drive bearing 141 and the pre-bearing 142, and the bearing chamber 143 and the lubricating ring gap 15 are in flow communication. In addition, a compensation line 145 is provided between the bearing chamber 143 and the low pressure side LP such that the lubricating fluid can flow from the bearing chamber 143 into the low pressure side LP in the operating state. Analog to the previous embodiment, in this variant the lubricating fluid flows, for example, from the lubricating ring gap 15 into the bearing chamber 143 in that the lubricating ring gap 15 and the bearing chamber 143 are in flow communication and/or a pressure difference is produced in the lubricating ring gap 15 by means of the compensation line 145 by which the vibrations of the rotor shaft 13 are advantageously damped and said rotor shaft is centered. This variant additionally makes it possible to combine a drive bearing 14 with a lubricating ring gap 15 so that the invention can be realized in a less complex and a less expensive manner based on known drive bearings 14 at which a bearing chamber 143 is present in that these pumps are retrofitted with its construction solutions.

Conversely, the lubricating fluid can also be supplied to the lubricating ring gap 15 via the bearing chamber 143 so that the lubricating fluid can flow, for example, from the high pressure side HP via the lubricant line 16 directly into the bearing chamber 143. The advantage of this variant in accordance with the invention is the very simple constructive design, whereby future pipes can be equipped with the additional damping very inexpensively. Alternatively, the lubricating fluid can also flow simultaneously at a plurality of points into the drive bearing 14, the bearing chamber 143 or the lubricating ring gap 15.

In the embodiment of a pump 1 in accordance with the invention shown in FIG. 2, the pump 1 is formed as a multistage pump 1 and includes at least one further pump rotor 12 rotatably supported about an axis of rotation A. A further lubricant opening 161 can be provided at the high pressure side HP of a further pump stage K and the further lubricant opening 161 can be in flow communication with the lubricant line 16.

Due to the described measure, the pump fluid can flow from any desired pump stage K into the lubricant line 16, with, in dependence on the application, a plurality of lubricant lines 16 from different pump stages K also being possible so that the pressure in the lubrication ring gap 15 and thus the degree of damping or of stiffness of the vibration-capable rotor shaft 13 can be set in a very simple manner and very flexibly to different demands and changing operating conditions. This embodiment is particularly of advantage for multistage pumps 1 since their rotor shafts 13 are usually disproportionately long and make very high demands, in particular at high speeds and on the drive side AS, to the damping or support, and which are satisfied by the invention.

It is possible by use of specific embodiment variants to retrofit the drive bearing in accordance with the invention shown in FIG. 2 for a pump of the prior art so that the whole pump does not have to be replaced to make use of the advantages of the invention. This is possible, for example, in that a drive bearing in accordance with the invention is simply adapted to the geometry of a known older pump and is installed in it within the framework of a regular service. This means that the older drive bearings which have the initially described problems with the harmful vibrations can be simply replaced with drive bearings of the present invention.

A supply bore can also be provided as a special measure in the drive bearing in accordance with the invention which is designed, for example, as a valve, with corresponding lines for supplying the lubricating fluid being provided, for example, at or in the housing and with the supply bore being in flow communication with them. The shape and geometry of the supply bore is in this respect designed and arranged so that a predefined quantity of lubricating fluid can be supplied to the lubricating ring gap for forming the hydrodynamic lubricant layer.

FIG. 3 shows a further advantageous embodiment of a pump 1 in accordance with the invention, with a pre-bearing bore 1421 for supplying the lubricating fluid into a pre-bearing gap 1422 between the pre-bearing 142 and the rotor shaft 13 being provided in the pre-bearing 142 and/or with a pre-bearing chamber 1423 being provided on the drive side in front of the pre-bearing 142 and/or with a pre-bearing line 1424 being provided between the pre-bearing chamber 1423 and the low pressure side LP so that the lubricating fluid can flow from the pre-bearing chamber 1423 into the low pressure side LP in the operating side. The mode of operation of this embodiment substantially corresponds to the embodiment shown in FIG. 2; only the design of the pre-bearing gap 1422 between the pre-bearing 14 and the rotor shaft 13, the axial flow direction of the lubricating fluid, that is from the pre-bearing gap 1422 in the direction of the pre-bearing chamber 1423 and the pre-bearing line 1424 between the pre-bearing chamber 1423 and the low pressure side LP being different.

It is understood that all the above-described embodiments of the invention are only to be understood as examples or by way of example and that the invention in particular, but not only, includes all suitable combinations of the described embodiments.

The invention claimed is:

1. A multistage pump for conveying a pump fluid, wherein the pump fluid provided at an inlet pressure at a low pressure side (LP) of the pump (1) can be conveyed in the operating state to a high pressure side (HP) of the pump rotor (12) by means of a pump rotor (12) rotatably supported about an axis of rotation (A) in a pump stator (11) and wherein a rotor shaft (13) with a drive side and a non-drive side is arranged with the pump rotor (12) at an additional bearing (14), which is located on the drive side, whereby the rotor shaft (13) is supported on the drive side in an outer bearing and can be coupled to the drive by means of a coupling, characterized in that the additional bearing (14) is arranged between the outer bearing and the pump rotor (12) and a lubricating film which is formed from a lubricating fluid formed from the pump fluid can be formed on the drive side (AS) of the rotor shaft (13) between the rotor shaft (13) and the additional bearing (14) in a lubricating ring gap (15), with a lubricant line (16) being provided such that the lubricating fluid can be supplied to the lubricating ring gap (15) between the rotor shaft (13) and the additional bearing (14).

2. A pump in accordance with claim 1, wherein the additional bearing (14) is designed in two parts, including a main bearing (141) and a pre-bearing (142).

3. A pump in accordance with claim 2, wherein a pre-bearing bore (1421) for supplying the lubricating fluid into a pre-bearing gap (1422) between the pre-bearing (142) and the rotor shaft (13) is provided in the pre-bearing (142).

4. A pump in accordance with claim 2, wherein a pre-bearing chamber (1423) is provided on the drive side in front of the pre-bearing (142).

5. A pump in accordance with claim 2, wherein a compensation line (1424) is provided between a pre-bearing chamber (1423) and the low pressure side (LP) such that the lubricating fluid can flow from the pre-bearing chamber (1424) into the low pressure side (LP) in the operating state.

6. A pump in accordance with claim 1, wherein a lubricant opening (161) is provided at the high pressure side (HP) and the lubricant opening (161) is in flow communication with the lubricant line (16).

7. A pump in accordance with claim 1, wherein a supply bore (144) for supplying the lubricating fluid is provided in the additional bearing (14).

8. A pump in accordance with claim 1, wherein the lubricating ring gap (15) and the low pressure side (LP) are in flow communication and wherein the lubricating fluid flows along the rotor shaft (13) in the direction of the low pressure side (LP).

9. A pump in accordance with claim 1, wherein a bearing chamber (143) is provided on the drive side (AS) at the additional bearing (14), between a main bearing (141) and a pre-bearing (142), and the bearing chamber (143) and the lubricating ring gap (15) are in flow communication.

10. A pump in accordance with claim 9, wherein a compensation line (145) is provided between the bearing chamber (143) and the low pressure side (LP) such that the lubricating fluid can flow from the bearing chamber (143) into the low pressure side (LP) in the operating state.

11. A pump in accordance with claim 9, wherein the lubricating fluid can be supplied to the lubricating ring gap (15) via the bearing chamber (143).

12. A pump in accordance with claim 1, wherein a further lubricant opening (161) is provided at the high pressure side (HP) of a further pump stage (K) and the further lubricant opening (161) is in flow communication with the lubricant line (16).

13. A pump in accordance with claim 1, wherein the pump (1) includes an external source for the supply of the lubricating fluid, with the external source not corresponding to a pump stage (K).

* * * * *